US011363926B2

(12) United States Patent
Scheufen et al.

(10) Patent No.: US 11,363,926 B2
(45) Date of Patent: Jun. 21, 2022

(54) HOLDER FOR VACUUM CLEANER DUST CONTAINER

(71) Applicant: Aktiebolaget Electrolux, Stockholm (SE)

(72) Inventors: Bert Scheufen, Nuremberg (DE); Patrik Werius, Stockholm (SE); Simon Faremo, Stockholm (SE)

(73) Assignee: Aktiebolaget Electrolux

( * ) Notice: Subject to any disclaimer, the term of this patent is extended or adjusted under 35 U.S.C. 154(b) by 484 days.

(21) Appl. No.: 16/462,656

(22) PCT Filed: Nov. 23, 2016

(86) PCT No.: PCT/EP2016/078497

§ 371 (c)(1),
(2) Date: May 21, 2019

(87) PCT Pub. No.: WO2018/095519

PCT Pub. Date: May 31, 2018

(65) Prior Publication Data

US 2019/0313869 A1 Oct. 17, 2019

(51) Int. Cl.
*A47L 9/14* (2006.01)

(52) U.S. Cl.
CPC ..... *A47L 9/1445* (2013.01)

(58) Field of Classification Search
CPC ..... A47L 9/00; A47L 9/1436; A47L 9/1445
See application file for complete search history.

(56) References Cited

U.S. PATENT DOCUMENTS 3,209,523 A * 10/1965 Smithson ..... A47L 9/1436 55/374
5,778,487 A * 7/1998 Schuld ..... A47L 5/365 15/327.6

(Continued)

FOREIGN PATENT DOCUMENTS

CN 101172025 A 5/2008
DE 202006016789 U1 12/2006

(Continued)

OTHER PUBLICATIONS

International Search Report and Written Opinion for International Application No. PCT/EP2016/078497, dated Aug. 16, 2017—9 pages.

(Continued)

*Primary Examiner* — Marc Carlson
(74) *Attorney, Agent, or Firm* — RatnerPrestia

(57) ABSTRACT

A vacuum cleaner dust container holder for holding a dust container having a connector plate. The holder has an insert slot configured to receive the connector plate of the dust container and configured to hold the connector plate in a working position within a vacuum cleaner during use of the vacuum cleaner. The insert slot is configured to bend at least a first portion of the connector plate upon insertion of the connector plate into the insert slot, or configured to bend at least a first portion of the connector plate after insertion of the connector plate into the insert slot. A connector plate for a vacuum cleaner dust container, and a vacuum cleaner comprising a holder are also provided.

14 Claims, 4 Drawing Sheets

(56) References Cited

U.S. PATENT DOCUMENTS

| | | | | |
|---|---|---|---|---|
| 8,439,997 | B2 * | 5/2013 | Rupp | A47L 9/1436 55/373 |
| 10,952,581 | B2 * | 3/2021 | Werius | A47L 9/1436 |
| 2007/0113528 | A1 * | 5/2007 | Knuth | A47L 9/1427 55/472 |
| 2009/0089966 | A1 * | 4/2009 | Sohn | A47L 9/1427 15/350 |
| 2012/0304415 | A1 * | 12/2012 | Bosses | A47L 9/1436 15/347 |
| 2019/0350421 | A1 * | 11/2019 | Werius | A47L 9/1436 |

FOREIGN PATENT DOCUMENTS

| | | | | |
|---|---|---|---|---|
| EP | 0009471 | A1 * | 4/1980 | A47L 9/1436 |
| EP | 0362624 | A1 | 4/1990 | |
| EP | 0499168 | A1 | 8/1992 | |
| EP | 1917897 | A2 * | 5/2008 | A47L 9/1445 |
| EP | 1917897 | A2 | 5/2008 | |
| EP | 3454714 | A1 * | 3/2019 | A47L 9/1445 |
| FR | 2800980 | A1 * | 5/2001 | A47L 9/1427 |
| FR | 3026629 | A1 | 4/2016 | |
| JP | 04122336 | A | 4/1992 | |
| WO | 0224046 | A1 | 3/2002 | |
| WO | 2017196211 | A1 | 11/2017 | |

OTHER PUBLICATIONS

Chinese Office Action for Chinese Application No. 201680090757.1, dated Sep. 17, 2020, 13 pages.

European Communication pursuant to Article 94(3) for European Application No. 16 800 939.7, dated Feb. 22, 2021, 5 pages.

Russian Office Action for Russian Application No. 2019119023, dated Dec. 11, 2019 iwth translation, 9 pages.

New Zealand Examination Report for New Zealand Application No. 752487, dated Sep. 22, 2021, 4 pages.

* cited by examiner

HOLDER FOR VACUUM CLEANER DUST CONTAINER

TECHNICAL FIELD

The present disclosure relates to a holder for a vacuum cleaner dust container, wherein the holder comprises a holding structure configured to receive a connector plate of the dust container. The present disclosure also relates to a connector plate for a vacuum cleaner dust container, a vacuum cleaner dust container comprising a connector plate, and a vacuum cleaner comprising a holder.

BACKGROUND

A holder for a vacuum cleaner dust container usually comprises some kind of holding structure configured to receive a connector plate of the dust container. Thanks to the holder and the connector plate, an opening of the dust bag can be reliably positioned and oriented to receive a flow of dust laden air from a vacuum cleaner inlet. An example of a vacuum cleaner dust container comprising a connector plate is disclosed for instance in WO-02/24046-A1. For safety and reliability reason it is important to position the dust container correctly in the vacuum cleaner, this to avoid that dust laden airflow is entering the motor fan without the dust being separated in the dust container first. Another aspect of the holder and the connector plate is that it should make it easy for a user to handle them. Consumer demands have led to development of compact vacuum cleaners with small outer dimensions.

A dust bag of a vacuum cleaner dust container must be provided with certain volume to separate dust from the flow of air efficiently and to maintain a reasonable operation time before the dust bag has been filled with dust and therefore needs replacement. This may pose a challenge when it comes to compact vacuum cleaners since the small outer dimensions limit the available space inside the vacuum cleaner.

A problem associated with holders and connector plates of this type is how to make the holder and the connector plate operable and easy to use with even more efficient and compact vacuum cleaners.

SUMMARY

It is an object of the present invention to provide conditions for an efficient utilization of volume within a vacuum cleaner.

According to an aspect of the invention, the object is achieved by a holder for a vacuum cleaner dust container, the dust container comprising a dust bag, made of an air permeable material, and a connector plate surrounding an opening in the dust bag. The holder comprises a holding structure configured to receive the connector plate of the dust container and configured to hold the connector plate in a working position within a vacuum cleaner during use of the vacuum cleaner. The holding structure is configured to bend at least a first portion of the connector plate upon insertion of the connector plate into the holding structure, or configured to bend at least a first portion of the connector plate after insertion of the connector plate into the holding structure.

Since the holding structure of the holder configured to bend the at least first portion of the connector plate, the holder can better use the available space inside a vacuum cleaner, since the holder can be arranged closer to curved walls, such as a curved inner wall. Thus, the holder may closely follow such an inner wall efficiently taking up less space due to the bending of the at least a first portion of the connector plate. The whole length of the connector plate may still contribute in keeping the vacuum cleaner dust container safely in the working position.

Accordingly, conditions for an efficient utilization of volume within the vacuum cleaner are provided. As a result, the above mentioned object is achieved.

Further, since the available space inside a vacuum cleaner can be better used, a vacuum cleaner using the holder provided may be made more compact. As an alternative, or in combination, the volume of the dust bag may be increased.

Still further, since the at least first portion of the connector plate will be bent by the holding structure of the holder provided, the at least first portion of the connector plate may contribute to a certain locking of the connector plate.

Optionally, the holding structure is configured to bend the at least first portion of the connector plate in a direction towards the dust bag of the dust container. Thereby, the connector plate may better follow a curved shape of the dust bag, thereby decreasing a total volume occupied by the vacuum cleaner dust container. As a result thereof, the available dust bag volume may be increased. Further, a vacuum cleaner using the holder provided may be made even more compact since the holder may be arranged closer to a curved inner wall while allowing an increased dust bag volume.

Optionally, the holding structure is configured to bend the at least first portion of the connector plate upon insertion of the connector plate into the holding structure, and wherein the holding structure comprises an insert slot at least being partially curved. Thereby, an easy and reliable bending of the at least first portion of the connector plate can be achieved.

Optionally, the insert slot comprises an open end, an essentially straight portion and a curved portion, wherein the essentially straight portion connects the open end and the curved portion. Since the insert slot of the holding structure comprises the essentially straight portion, a second portion of the connector plate surrounding the opening in the dust bag can remain essentially flat. As a result, a reliable sealing between an inlet hose and the opening of the dust bag is provided.

Optionally, the curved portion is shorter in a direction along an extension of the insert slot than the essentially straight portion. Thereby, a total length of the holder and thus also a total length of connector plate to be inserted into the holder can be remained relatively short, while ensuring a sufficient length of the essentially straight portion to ensure a reliable sealing between an inlet hose and the opening of the dust bag.

Optionally, the holding structure is configured to bend the connector plate after insertion of the connector plate into the holding structure, and wherein the holder comprises a central portion and an extending portion projecting from the central portion in a plane thereof, wherein the extending portion is configured to be bent out of the plane of the central portion into a step-wise or continuous curvature. Thereby, a holder is provided into which insertion of a connector plate may be facilitated since the holding structure of the holder may have an essentially flat shape upon insertion of the connector plate. Thereby, a small force is required to insert the connector plate into the holder. Still, since the holding structure is configured to bend the connector plate after insertion of the connector plate into the holding structure, a holder is provided which better can use available space inside a vacuum cleaner canister due to the bending of the at least first portion of the connector plate.

Optionally, the extending portion of the holder is configured to be bent by a force achieved by an insertion of the holder into the vacuum cleaner, or configured to be bent by a force of a lid of the vacuum cleaner being displaced from an open position to a closed position. Thereby, an easy, user-friendly and reliable bending of the at least first portion of the connector plate is achieved.

Optionally, the extending portion of the holder is provided with a lower bending stiffness than the central portion. Thereby, an easy, user-friendly and reliable bending of the at least first portion of the connector plate is achieved, while ensuring an essentially flat second portion of the connector plate to provide a reliable sealing between an inlet hose and the opening of the dust bag.

Optionally, the extending portion of the holder is provided with a lower bending stiffness than the central portion by means of a plurality of living hinges located along the extending portion. Thereby, a lower bending stiffness of the extending portion is achieved in an easy and reliable manner. Further, the lower bending stiffness can be achieved even when using the same material in the extending portion and the central portion of the holder, for example in an injection moulding process.

Optionally, the extending portion of the holder is shorter in a direction along the holding structure of the holder than the central portion. Thereby, a total length of the holder and thus also a total length of connector plate to be inserted into the holder can be remained relatively short, while ensuring a sufficient length of the essentially straight portion of the holder as well as a sufficient length of the second portion of the connector plate to ensure a reliable sealing between an inlet hose and the opening of the dust bag.

Optionally, the holding structure comprises an insert slot and a further insert slot opposing the insert slot, wherein the insert slot and the further insert slot each comprises a respective open end for insertion of the connector plate into the holding structure. Thereby, a reliable and user-friendly holding structure is provided capable of bending the at least first portion of the connector plate.

Optionally, the respective open ends are tapered in a direction coinciding with an intended direction of insertion of the connector plate into the holding structure. Thereby, insertion of a connector plate into the holder is facilitated.

Optionally, the holder comprises one or more locking elements configured to lock the connector plate to the holder when the connector plate is fully received in the holding structure. As a result, the connector plate and thus also the dust bag will be kept safely in the working position. Further, the bending of the at least first portion of the connector plate may also contribute to a certain locking of the connector plate.

Optionally, the holder is configured to bend the connector plate so that a beta angle less than 170 degrees is formed between a first surface normal of a first side surface of the connector plate pointing in an intended direction of insertion of the connector plate into the holding structure, and a second surface normal of a second side surface of the connector plate being opposite to the first side surface. Thereby, a sufficient bending of the at least first portion is provided ensuring an efficient utilization of volume within the vacuum cleaner.

Optionally, the holder is configured to bend the connector plate so that the beta angle becomes within the range of 90-170 degrees, preferably in the range of 110-150 degrees. Thereby, a sufficient bending of the at least first portion is provided ensuring an efficient utilization of volume within the vacuum cleaner.

According to an aspect of the invention, the object is achieved by a connector plate for a vacuum cleaner dust container configured to assume a bent shape by a holder according to some embodiments. Since the connector plate is configured to assume a bent shape the volume within a vacuum cleaner, conditions are provided for an efficient utilization of volume within a vacuum cleaner since the connector plate can be arranged closer to curved walls of the vacuum cleaner, such a curved inner wall. Thus, the connector plate may closely follow such an inner wall efficiently taking up less space due to the bending of the least a first portion of the connector plate. The whole length of the connector plate may still contribute in keeping the dust bag safely in the working position.

Thus, the above mentioned object is achieved.

Further, since the at least first portion of the connector plate will be bent by the holding structure, the at least first portion of the connector plate may contribute to a certain locking of the connector plate.

Optionally, the connector plate comprises a back surface having an opening for an airflow, a first side surface adapted to be inserted into the holder, a second opposite side surface, a third side surface connecting the first and second side surfaces, and a forth side surface connecting the first and second side surfaces, wherein the connector plate comprises a first portion arranged between the opening and the first side surface, wherein the first portion is flexible. As a result, bending of the first portion of the connector plate by a holder is facilitated.

Optionally, the third side surface and the forth side surface are both adapted to slide in the holder.

Optionally, the second side surface is arranged closer to the opening than the first side surface. Thereby, a total length of the connector plate can be remained relatively short, while ensuring a sufficient length of a second portion of the connector plate surrounding the opening in the dust bag, as well as a sufficient length of the first portion to ensure that conditions are provided for an efficient utilization of volume within a vacuum cleaner.

According to an aspect of the invention, the object is achieved by a vacuum cleaner dust container, the dust container comprising a dust bag, made of an air permeable material, and a connector plate according to some embodiments. Thereby, a vacuum cleaner dust container provided which provides conditions for an efficient utilization of volume within a vacuum cleaner since the vacuum cleaner dust container comprises a connector plate which can be arranged closer to curved walls of the vacuum cleaner, such as a curved inner wall. Thereby a total volume occupied by the vacuum cleaner dust container may be decreased. As a result thereof, the available dust bag volume may be increased. Further, a vacuum cleaner using the holder provided may be made even more compact since the holder may be arranged closer to a curved inner wall while allowing an increased dust bag volume.

Thus, conditions are provided for a vacuum cleaner dust container having a larger volume while not affecting, or even improving compactness of a vacuum cleaner using the vacuum cleaner dust container. Accordingly, conditions for an efficient utilization of volume within the vacuum cleaner are provided. As a result, the above mentioned object is achieved.

According to an aspect of the invention, the object is achieved by a vacuum cleaner comprising a holder according to some embodiments. Thereby, conditions are provided for an efficient utilization of volume within the vacuum cleaner.

As a result, the above mentioned object is achieved.

Further features of, and advantages with, the present invention will become apparent when studying the appended claims and the following detailed description.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
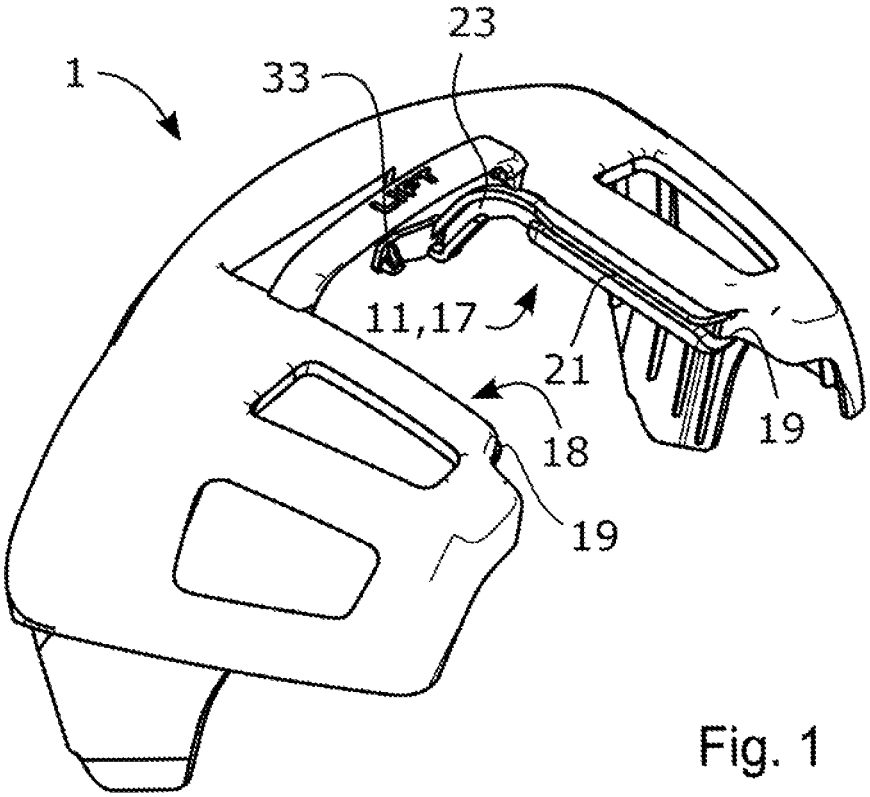
FIG. 1 illustrates a holder for a vacuum cleaner dust container, according to some embodiments.
Figure 2:
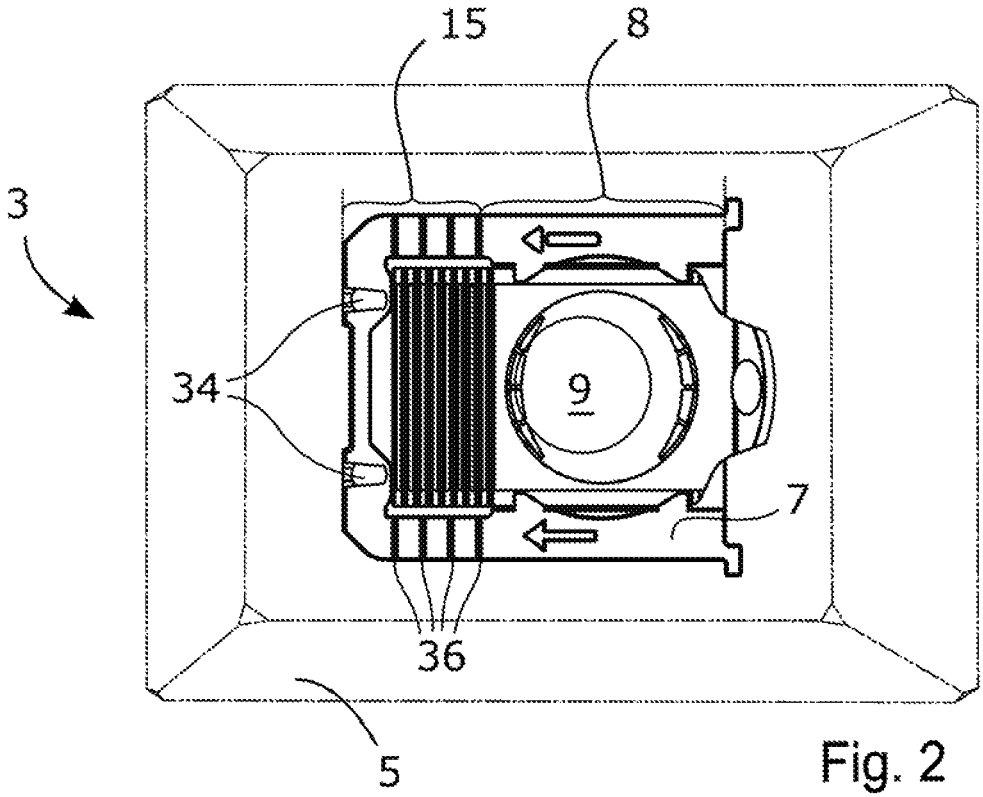
FIG. 2 illustrates a dust container according to some embodiments comprising a dust bag, and a connector plate surrounding an opening in the dust bag.

FIG. 1 illustrates a holder 1 for a vacuum cleaner dust container. FIG. 2 illustrates the dust container 3 which comprises a dust bag 5, made of an air permeable material, and a connector plate 7 surrounding an opening 9 in the dust bag 5. As illustrated in FIG. 1, the holder 1 comprises a holding structure 11. The holding structure 11 is configured to receive the connector plate 7 of the dust container 3 and is configured to hold the connector plate 7 in a working position within a vacuum cleaner during use of the vacuum cleaner. The holding structure 11 of the holder 1 illustrated in FIG. 1 is configured to bend at least a first portion 15 of the connector plate 7 upon insertion of the connector plate 7 into the holding structure 11. The first portion 15 of the connector plate 7 is the portion of the connector plate 7 first being inserted into the holder 1.

According to the embodiments illustrated in FIG. 1, the holding structure 11 comprises an insert slot 17 at least being partially curved. The holding structure 11 also comprises a further insert slot 18 opposing the insert slot 17. In the embodiments illustrated in FIG. 1, the further insert slot 18 comprises the corresponding features as the insert slot 17 even though not visible in FIG. 1. The insert slot 17 and the further insert slot 18 each comprises a respective open end 19 for insertion of the connector plate 7 into the holding structure 11. The insert slot 17 comprises an essentially straight portion 21 and a curved portion 23, wherein the essentially straight portion 21 connects the open end 19 and the curved portion 23. Thereby, when the connector plate 7 is inserted into the holding structure 11, the connector plate 7 will be guided along, essentially straight portion 21 towards the curved portion 23. The essentially straight portion 21 will cause any substantial bending of the connector plate 7 since it is essentially straight. At the curved portion 23, the at least first portion 15 of the connector plate 7 will be subjected to bending forces caused by a force of insertion and the curvature of the curved portion 23. As a result, the holding structure 11 will bend the at least first portion 15 of the connector plate 7. Thereby, the holder 1 can better use available space inside a vacuum cleaner, since the holder 1 with a received connector plate 7 can be arranged closer to curved walls, such as a curved inner wall. The whole length of the connector plate 7 may still contribute in keeping the vacuum cleaner dust container 3 safely in the working position.

According to the embodiments illustrated in FIG. 1, the holding structure 11 is configured to bend the at least first portion 15 of the connector plate 7 in a direction towards the dust bag 5 of the dust container 3. Thereby, the connector plate 7 may better follow a curved shape of the dust bag 5, thereby decreasing a total volume occupied by the vacuum cleaner dust container 3. As a result thereof, the available volume of the dust bag 5 may be increased. Further, a vacuum cleaner using the holder 1 provided may be made even more compact since the holder 1 may be arranged closer to a curved inner wall while allowing an increased volume of the dust bag 5.

As is illustrated in FIG. 1, the respective open ends 19 of the insert slot 17 and the further insert slot 18 may be tapered in a direction coinciding with an intended direction of insertion of the connector plate 7 into the holding structure 11. Thereby, insertion of the connector plate 7 into the holder 1 is facilitated.

Further, the curved portion 23 of the insert slot 17 is shorter in a direction along an extension of the insert slot 17 than the essentially straight portion 21. A result of the curved portion 23 of the insert slot 17 being shorter in a direction along an extension of the insert slot 17 than the essentially straight portion 21 is that space is provided for a second portion 8 of the connector plate 7 surrounding the opening 9 in the dust bag 5. As mentioned, the essentially straight portion 21 of the insert slot 17 will not cause any substantial bending of the connector plate 7 since it is essentially straight. As a result, a proper airtight sealing can be ensured between an inlet hose and the opening 9 of the dust bag 5, when the holder 1 holds the connector plate 7 in the working position within a vacuum cleaner.

According to the embodiments illustrated in FIG. 1, the holder 1 comprises locking elements 33 configured to lock the connector plate 7 to the holder 1 when the connector plate 7 is fully received in the holding structure 11. The locking elements 33 may be configured to lock the connector plate 7 to the holder 1 by extending into lock openings 34 of the connector plate 7 when the connector plate 7 is fully received thereby requiring a predetermined pulling force, in the direction opposite to the insertion direction, in order to remove the vacuum cleaner dust container 3. Thereby, the vacuum cleaner dust container 3 is prevented from being removed inadvertently.

Additionally, by using a holder 1 comprising holding structure 11 with an insert slot 17 at least being partially curved, it becomes easier to locate the end of the holder 1, which receives the at least first portion 15 of the connector plate 7, closer to the part of the vacuum cleaner that contains e.g. control electronics. In general, a greater freedom to locate the end of the holder 1 where desired is obtained. A mechanical function may be provided in the holder end, verifying that a vacuum cleaner dust container 3 is correctly installed and prohibiting closing of a canister hatch unless a vacuum cleaner dust container is provided. Using holder 1 having an insert slot 17 with a curved portion 23 allows this function to be located at a number of positions along a canister periphery. In another example, if the inlet is located in the front of a canister, the connector plate 7 will be centred around this inlet. The holder 1 may still lead the connector plate 7 along the curved inner wall of the canister towards the rear of the canister where suitably the motor/fan combination, driving the air flow, and the associated electronics are located. This makes it possible to locate a function, that verifies that a vacuum cleaner dust container 3 is correctly installed, closer to the control electronics, which for instance simplifies wiring.

Figure 3A:
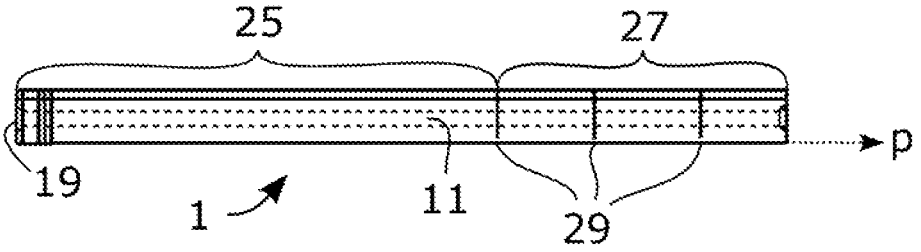
FIG. 3*a* illustrates a side view of a holder for a vacuum cleaner dust container, according to some embodiments, wherein the holder is in a straight position.
Figure 3B:
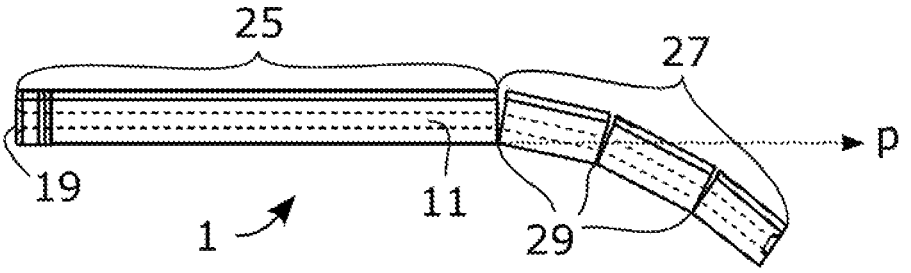
FIG. 3*b* illustrates a side view of a holder for a vacuum cleaner dust container, according to some embodiments, wherein the holder is in a bent position.

FIG. 3*a* and FIG. 3*b* illustrates a side view of a holder 1 for a vacuum cleaner dust container, according to some embodiments. The holder 1 comprises a holding structure 11. The holding structure 11 is configured to receive a connector plate of the dust container and is configured to hold the connector plate in a working position within a vacuum cleaner during use of the vacuum cleaner. The holding structure 11 may comprise one or more insert slots. The holding structure 11 of the holder 1 illustrated in FIG. 3*a* and FIG. 3*b* is configured to bend at least a first portion of the connector plate after insertion of the connector plate into the holding structure 11. According to the embodiments illustrated in FIG. 3*a* and FIG. 3*b*, the holder 1 comprises a central portion 25 and an extending portion 27 projecting from the central portion 25 in a plane p thereof, wherein the extending portion 27 is configured to be bent out of the plane p of the central portion 25 into an essentially step-wise curvature. The extending portion 27 is provided with a lower bending stiffness than the central portion 25 by means of a plurality of living hinges 29 located along the extending portion 27. The living hinges 29 are located along the extending portion 27 at regular intervals along the direction that the extending portion 27 extends from the central portion 25. This allows the lower stiffness to be achieved in an injection moulding process, not requiring further process steps to provide this feature and not requiring use of different materials in the central portion 25 and the extending portion 27 of the holder 1. As illustrated, living hinges 29 may be provided on the extending portion 27 at three locations. Needless to say fewer or more than three living hinges 29 may be provided. 3-6 living hinges 29 may be considered a suitable number.

Living hinges 29 are well known per se. A living hinge 29 forms a joint that can be easily bent, and with a plurality of living hinges 29 located at regular interval as illustrated in FIG. 3*a* and FIG. 3*b*, the extending portion 27 as a whole becomes easy to bend into a step-wise curvature. The extending portion 27 may be configured to be more easily bent in a first direction than in a second direction, when being in an essentially flat position, as is illustrated in FIG. 3*a*. In the illustrated example embodiments of FIG. 3*a* and FIG. 3*b*, the first direction corresponds to direction downwards and the second direction corresponds to a direction upwards. This feature is achieved in the illustrated example embodiments of FIG. 3*a* and FIG. 3*b* by grooves into the material of the holder 3 where material of the holder in a region of a respective groove acts as a living hinge 29. Polypropylene, PP, and polyethylene, PE, are examples of suitably materials for the holder 1.

Alternatively, the extending portion 27 may be configured to have a lower bending stiffness by being thinner than the central portion 25, or by comprising a material with a lower modulus of elasticity than the material of the central portion 25. The latter alternative may be obtained by providing the holder 1 in a two-component injection moulding process.

As a yet another alternative, or in combination, the extending portion 27 and the central portion 25 may have reinforcements in a pattern configured to provide the lower bending stiffness in the extending portion 27.

A connector plate of a dust container may be inserted into the holding structure 11 of the holder 1 when the holder 1 is in a position as is illustrated in FIG. 3*a*, i.e. in an essentially straight position. When a connector plate is fully inserted, a user may apply a force, or a torque, onto the holder 1 to thereby bend the extending portion 27 of the holder 1 to a position as is illustrated in FIG. 3*b*. As a result, the holding structure 11 of the holder 1 will bend the at least first portion of the connector plate during the bending of the extending portion 27.

According to some embodiments, the extending portion 27 of the holder 1 is configured to be bent by a force achieved by an insertion of the holder 1 into a vacuum cleaner. According to further embodiments, the extending portion 27 of the holder 1 is configured to be bent by a force of a lid of the vacuum cleaner being displaced from an open position to a closed position.

The holder 1 may further comprise one or more mounting portions, or mounting elements, arranged to fit with one or more mounting portions, or mounting elements of the vacuum cleaner. Such one or more mounting portions, or mounting elements, may be arranged at the extending portion 27 and/or at the central portion 25 of the holder 1.

According to the embodiments of the holder 1 illustrated in FIG. 3*a* and FIG. 3*b*, the extending portion 27 is shorter in a direction along the holding structure 11 of the holder 1 than the central portion 25. Thereby, a total length of the holder 1 and thus also a total length of connector plate to be inserted into the holder 1 can be remained relatively short, while ensuring a sufficient length of central portion 25. The central portion 25 of the holder 1 will not cause any substantial bending of the connector plate since it is essentially straight. Thus, sufficient space is provided for a second portion of the connector plate surrounding the opening in the dust bag, as illustrated in FIG. 2. As a result, a proper airtight sealing is ensured between an inlet hose and the opening of the dust bag, when the holder 1 holds the connector plate in the working position within a vacuum cleaner.

Figure 4A:
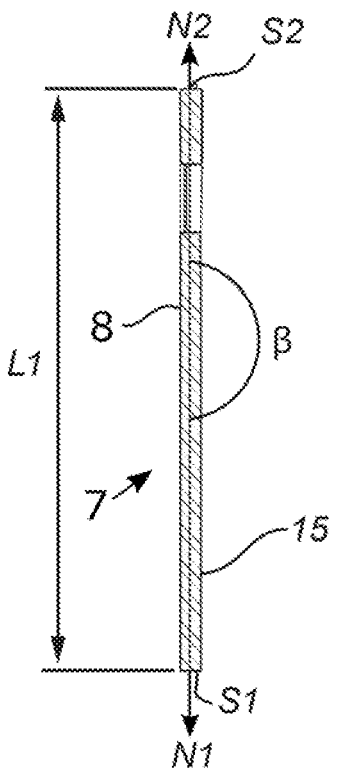
FIG. 4*a* illustrates a side view of a connector plate of a vacuum cleaner dust container, according to some embodiments, wherein the connector plate is in a straight position.
Figure 4B:
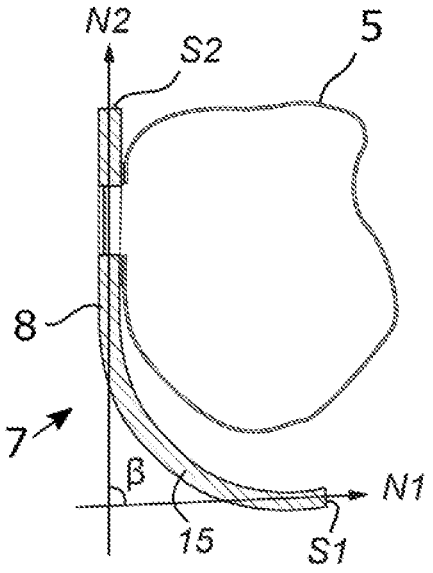
FIG. 4*b* illustrates a side view of a connector plate of a vacuum cleaner dust container, according to some embodiments, wherein the connector plate is in a bent position.

FIG. 4*a* and FIG. 4*b* illustrate a side view of a connector plate 7 of a vacuum cleaner dust container configured to assume a bent shape by a holder, according to some embodiments. In FIG. 4*a*, the connector plate 7 is illustrated in a flat position. In FIG. 4*b*, the connector plate 7 is illustrated in a bent position. The holder 1 according to the embodiments described herein may be configured to bend the connector plate 7 so that a beta angle β less than 170 degrees is formed between a first surface normal N1 of a first side surface S1 of the connector plate 7 pointing in an intended direction of insertion of the connector plate 7 into a holding structure of a holder, and a second surface normal N2 of a second side surface S2 of the connector plate 7 being opposite to the first side surface S1. Thereby, a sufficient bending of the at least first portion 15 is provided ensuring an efficient utilization of volume within the vacuum cleaner. The first side surface S1 is inserted into the holder 1 before the second side surface S2.

The holder may be configured to bend the connector plate 7 so that the beta angle β becomes within the range of 90-170 degrees, preferably in the range of 110-150 degrees. Thereby, a sufficient bending of the at least first portion 15 is provided ensuring an efficient utilization of volume within the vacuum cleaner. As can be seen in FIG. 4*a*, the beta angle β is 180 degrees when the connector plate 7 is in an un-bent, flat position.

Figure 5:
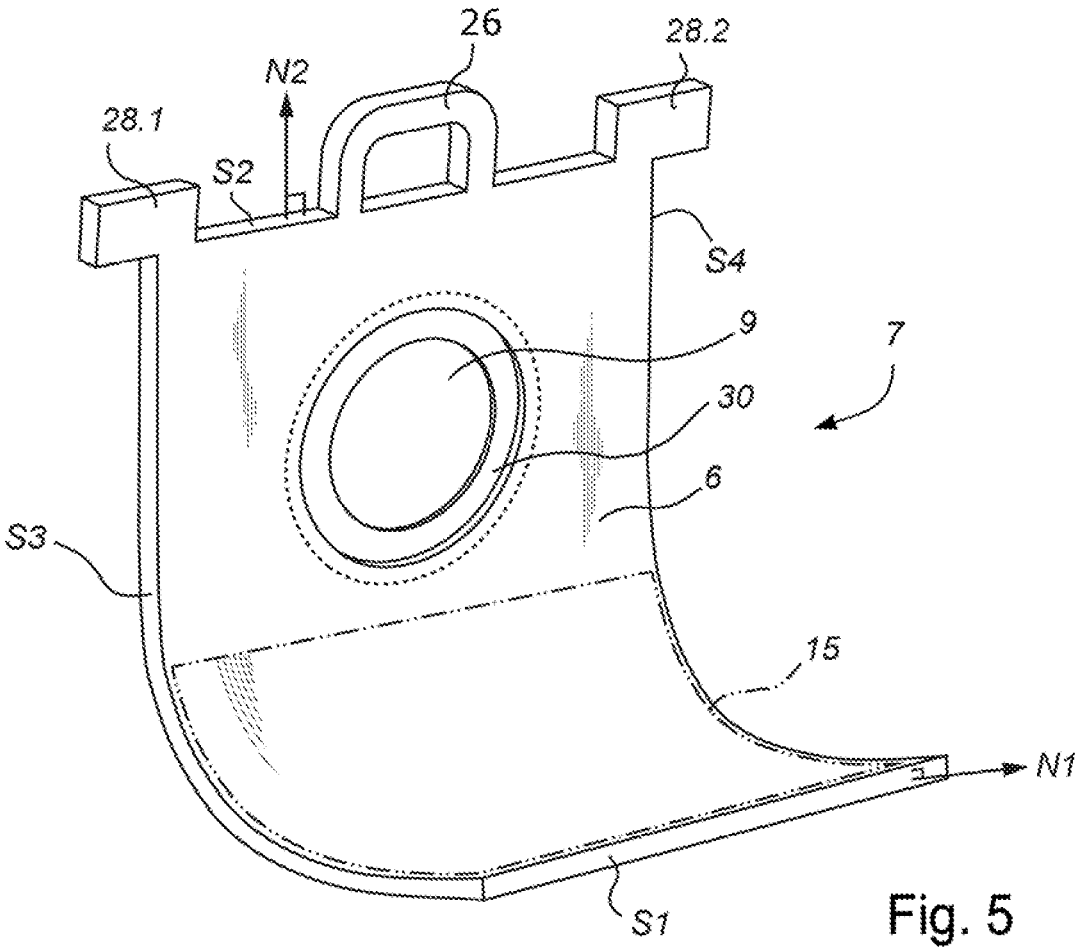
FIG. 5 illustrates a perspective view of a connector plate illustrated in FIG. 4*b*.

FIG. 5 illustrates a perspective view of a connector plate 7 illustrated in FIG. 4*b*. The connector plate 7 comprises a back surface 6 having an opening 9 for an airflow. The back surface 6 is the surface of the connector plate 7 onto which a dust bag is to be arranged. The connector plate 7 further comprises a first side surface S1 adapted to be inserted into a holder, a second opposite side surface S2, a third side surface S3 connecting the first and second side surfaces S1, S2, and a forth side surface S4 connecting the first and second side surfaces S1, S2. The connector plate 7 comprises a first portion 15 arranged between the opening 9 and the first side surface S1, wherein the first portion 15 is flexible. Thereby, bending of the first portion 15 is facilitated. The first side surface S1 will be the leading surface upon insertion of the connector plate 7 into a holder. Thus, the first surface normal N1 of a first side surface S1 of the connector plate 7 points in an intended direction of insertion of the connector plate 7 into the holder. The third side surface S3 and the forth side surface S4 are both adapted to slide in the holder. That is, in embodiments of the holder 1 as illustrated in FIG. 1, the third side surface S3 and the forth side surface S4 of the connector plate 7 are both adapted to slide in a respective insert slot 17, 18 of the holding structure 11 of the holder 1. In embodiments of the holder 1 as illustrated in FIGS. 3*a* and 3*b*, the third side surface S3 and the forth side surface S4 of the connector plate 7 are both adapted to slide in the holding structure 11 of the holder 1. The connector plate 7 further comprises a handle 26 facilitating insertion and removal of the connector plate 7 into, and out of, a holder. The connector plate 7 also comprises two tabs 28.1, 28.2. A first tab 28.1 extends sideways outside the third surface S3 and a second tab 28.2 extends sideways outside the fourth surface S4 for stopping the connector plate 7 from being inserted too much in a holder. Further the connector plate 7 comprises a gasket 30 arranged to seal an area between the opening 9 and an inlet hose of a vacuum cleaner.

The first portion 15 of the connector plate 7 is flexible about an axis parallel to the first side surface S1. The first portion 15 of the connector plate 7 may be flexible by comprising a flexible material. As an alternative, or in combination, the first portion 15 of the connector plate 7 may be flexible by comprising one or more a living hinges, perforations, or a rib structure.

In the embodiments of the connector plate 7 illustrated in FIG. 5, the second side surface S2 is arranged closer to the opening 9 than the first side surface S1. Thereby, a total length of the connector plate 7 can be remained relatively short, while ensuring a sufficient length of the first portion 15 to ensure that conditions are provided for an efficient utilization of volume within a vacuum cleaner. In the embodiments of the connector plate 7 illustrated in FIG. 5, the total length of the connector plate 7 essentially corresponds to a length of the third side surface S3, as well as a length of the forth side surface S4.

The connector plate 7 may mainly or wholly be made of plastic, preferably polypropylene, paper, preferably card board, metal, or a wood-based material.

FIG. 2 illustrates a connector plate 7 comprising living hinges 36 which makes the first portion 15 of the connector plate 7 flexible. The connector plate 7 illustrated comprises four living hinges 36. Needless to say fewer or more than four living hinges 36 may be provided along the direction in which the connector plate 7 is inserted in a holder. 3-6 living hinges 36 may be considered a suitable number. When a connector plate 7 according to those embodiments is to be used in a holder 1 as illustrated in the FIGS. 3*a* and 3*b*, three living hinges 36 may be located at positions of the connector plate 7 such that when the connector plate 7 is inserted fully into the holder, a respective living hinge 36 of the connector plate 7 faces a respective living hinge 29 of the holder 1. Thereby, the holder 1 may efficiently bend the first portion 15 of the connector plate 7 when the extending portion 27 of the holder is bent out of the plane p of central portion 25 into an essentially step-wise curvature.

A living hinge 36 of the connector plate 7 may comprise a thin, interconnecting portion joining two wider segment portions, all being made in one piece through injection molding. A V-shaped groove may be formed in between the two segment portions. Polypropylene, PP, and polyethylene, PE, are examples of suitably used materials. Living hinges are well known per se. The hinge forms a joint that can be very easily bent, and with a plurality of living hinges located at regular interval as illustrated in FIG. 2, the first portion 15 as a whole becomes very easy to bend into a step-wise curvature. The first portion 15 may be configured to be more easily bent downwards towards the dust bag 5, as when bent upwards, said V-shaped grooves may eventually be closed and may thereby limit the movement. The first portion 15 may comprise arm portions where each living hinge is divided into two parts at the same location along which the first portion 15 extends from the second portion 8 of the connector plate 7.

In an example, the segment portions have a thickness of 3 mm, while the interconnecting, portion is only 0.3 mm thick. An interval between 2.0-4.5 mm is considered for the thicker portion, and 0.1-0.4 mm for the thinner. The cc distance between adjacent living hinges 36 may be in the interval between 5-10 mm, a suitable distance being 8 mm. Needless to say these dimensions are examples.

A reinforcement flange may interconnect the leg segment portions at a location along the length of the living hinge 36. This reinforcement flange substantially inhibits the function of the living hinge 36, i.e. prevents the connector plate 7 to be bent in the living hinge 36, until the reinforcement flange is broken. As the reinforcement flange may be very thin, this is easily done, but unless bent with some force, the connector plate nevertheless remains more or less flat. A thickness of about 0.3 mm along the length of the living hinge 36 is considered.

Figure 6:
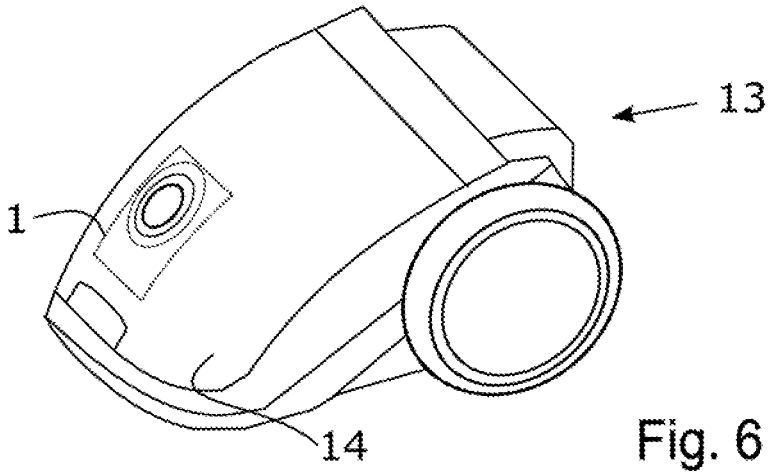
FIG. 6 illustrates a vacuum cleaner comprising a holder according to some embodiments.

FIG. 6 illustrates a vacuum cleaner 13 comprising a holder 1 according to some embodiments. In embodiments where the holding structure of the holder 1 is configured to bend at least a first portion of the connector plate after insertion of the connector plate into the holding structure 11, the extending portion of the holder 1 may be configured to be bent by a force achieved by an insertion of the holder 1 into the vacuum cleaner 13, or may be configured to be bent by a force of a lid 14 of the vacuum cleaner 13 being displaced from an open position to a closed position. In FIG. 4, the lid 14 is illustrated in the closed position.

It is to be understood that the foregoing is illustrative of various example embodiments and that the invention is defined only by the appended claims. A person skilled in the art will realize that the example embodiments may be modified, and that different features of the example embodiments may be combined to create embodiments other than those described herein, without departing from the scope of the present invention, as defined by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A holder for a vacuum cleaner dust container having a dust bag made of an air permeable material and a connector plate surrounding an opening in the dust bag, the holder comprising:

an insert slot configured to receive the connector plate of the dust container and configured to hold the connector plate in a working position within a vacuum cleaner during use of the vacuum cleaner, the insert slot being configured to bend a first portion of the connector plate upon insertion of the connector plate into the insert slot;

wherein the insert slot comprises:

a curved portion configured to bend the first portion of the connector plate upon insertion of the connector plate into the insert slot;

an open end, and a straight portion, wherein the straight portion connects the open end and the curved portion, wherein the straight portion extends along a first direction, and the curved portion is shorter as measured along the first direction than the straight portion.

2. The holder according to claim 1, wherein the insert slot is configured to bend the first portion of the connector plate in a direction towards the dust bag of the dust container.

3. The holder according to claim 1, wherein the holder comprises the insert slot and a further insert slot opposing the insert slot, wherein the insert slot and the further insert slot each comprises a respective open end for insertion of the connector plate into the holder.

4. The holder according to claim 3, wherein the respective open ends are tapered in a direction coinciding with an intended direction of insertion of the connector plate into the holder.

5. The holder according to claim 1, wherein the holder comprises one or more locks configured to lock the connector plate to the holder when the connector plate is fully received in the insert slot.

6. The holder according to claim 1, wherein the first portion of the connector plate is configured to be inserted into the holder before a remaining portion of the connector plate.

7. The holder according to claim 1, wherein the holder is configured to bend a distal end of the first portion at a beta angle of less than 170 degrees is formed between the distal end of the first portion and an unbent remaining portion of the connector plate.

8. The holder according to claim 7, wherein the holder is configured to bend the connector plate so that the beta angle is within a range of 90-170 degrees.

9. The holder according to claim 7, wherein the holder is configured to bend the connector plate so that the beta angle is within the range of 110-150 degrees.

10. A connector plate for a vacuum cleaner dust container, the connector plate having a central portion having an opening configured to surround an opening in an attached dust bag, and an extending portion attached to an end of the central portion, the extending portion being movable between a first position in which the extending portion projects from the central portion in a plane of the central portion, and a second position in which the extending portion is bent out of the plane of the central portion by at least 10 degrees into a step-wise or continuous curvature.

11. The connector plate according to claim 10, wherein the extending portion is configured to bend to form an angle of 90 to 170 degrees relative to the central portion.

12. The connector plate according to claim 10, wherein the extending portion is configured to bend to form an angle of 110 to 150 degrees relative to the central portion.

13. A vacuum cleaner comprising:

a lid configured to selectively open and close; and a holder for a vacuum cleaner dust container having a dust bag made of an air permeable material and a connector plate surrounding an opening in the dust bag, the holder being attached to the lid and comprising an insert slot configured to receive the connector plate of the dust container and configured to hold the connector plate in a working position within the vacuum cleaner during use of the vacuum cleaner, wherein the connector plate comprises a first portion and a second portion extending from the first portion, and the insert slot is configured to bend the first portion by at least 10 degrees relative to the second portion either upon insertion of the connector plate into the insert slot, or after insertion of the connector plate into the insert slot.

14. A holder for a vacuum cleaner dust container having a dust bag made of an air permeable material and a connector plate surrounding an opening in the dust bag, the holder comprising:

an insert slot configured to receive the connector plate of the dust container and configured to hold the connector plate in a working position within a vacuum cleaner during use of the vacuum cleaner, the insert slot being configured to bend a first portion of the connector plate either upon insertion of the connector plate into the insert slot, or after insertion of the connector plate into the insert slot;

wherein the insert slot is configured to bend the connector plate after insertion of the connector plate into the insert slot, and wherein the insert slot comprises a central portion and an extending portion, the extending portion being movable between a first position in which the extending portion projects from the central portion in a plane of the central portion, and a second position in which the extending portion is bent out of the plane of the central portion into a step-wise or continuous curvature; and wherein the extending portion is configured to be bent from the first position to the second position by a force achieved by an insertion of the holder into the vacuum cleaner, or configured to be bent by a force of a lid of the vacuum cleaner being displaced from an open position to a closed position.

* * * * *